US009926115B2

(12) United States Patent
Jung et al.

(10) Patent No.: US 9,926,115 B2
(45) Date of Patent: Mar. 27, 2018

(54) SIDE PRESS-TYPE SAFETY CAP

(71) Applicant: YONWOO CO.,LTD., Incheon (KR)

(72) Inventors: Seo-Hui Jung, Incheon (KR); Sung-Woo Cheon, Incheon (KR); Shin-Bok Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 14/902,695

(22) PCT Filed: Jan. 27, 2014

(86) PCT No.: PCT/KR2014/000734
§ 371 (c)(1),
(2) Date: Jan. 4, 2016

(87) PCT Pub. No.: WO2015/111774
PCT Pub. Date: Jul. 30, 2015

(65) Prior Publication Data

US 2016/0167847 A1 Jun. 16, 2016

(30) Foreign Application Priority Data

Jan. 22, 2014 (KR) ..... 10-2014-0007657

(51) Int. Cl.
*B65D 50/04* (2006.01)
*B65D 41/04* (2006.01)

(52) U.S. Cl.
CPC ..... *B65D 50/041* (2013.01); *B65D 41/0492* (2013.01); *B65D 2215/00* (2013.01); *B65D 2215/02* (2013.01)

(58) Field of Classification Search
CPC .... B65D 50/048; B65D 50/041; B65D 85/70; B65D 85/82; B65D 41/0492; B65D 2215/00; B65D 2215/02; B65D 2215/04
(Continued)

(56) References Cited

U.S. PATENT DOCUMENTS 3,756,444 A * 9/1973 McIntosh ..... B65D 50/041 215/220
3,795,337 A * 3/1974 Nozawa ..... B65D 50/041 215/219

(Continued)

FOREIGN PATENT DOCUMENTS

| | | |
|---|---|---|
| JP | 08-268452 | 10/1996 |
| KR | 20-0385310 Y1 | 5/2005 |
| WO | WO-99/28205 A1 | 6/1999 |

OTHER PUBLICATIONS

International Search Report issued in PCT/KR2014/000734 dated Mar. 28, 2014.

*Primary Examiner* — J. Gregory Pickett
*Assistant Examiner* — Gideon Weinerth
(74) *Attorney, Agent, or Firm* — Marshall, Gerstein & Borun LLP

(57) ABSTRACT

The invention disclosed herein relates to a side press safety cap, wherein when an outer cap is rotated to opening direction with sides of the outer cap pressurized, a first rotation protrusion of an outer cap is interlocked with open guide protrusions of an inner cap, rotating the inner cap, and thereby an inner cap is opened. On the other hand, when the outer cap is rotated to closing direction, a second rotation protrusion is interlocked with close guide protrusions, rotating the inner cap and thereby the inner cap is closed. As a result, the side press safety cap is possible to be opened and closed stably.

4 Claims, 6 Drawing Sheets

(58) Field of Classification Search
USPC ..... 215/216, 217
See application file for complete search history.

(56) References Cited

U.S. PATENT DOCUMENTS 3,820,676 A * 6/1974 Mucsi ..... B65D 50/043 215/220
3,887,099 A * 6/1975 Gillman ..... B65D 50/041 215/220
3,888,375 A * 6/1975 Gerk ..... B65D 50/041 215/219
3,918,920 A * 11/1975 Barber ..... B01L 9/06 206/306
4,037,747 A * 7/1977 Acton ..... B65D 50/041 215/219
4,345,690 A * 8/1982 Hopley ..... B65D 50/046 215/216
4,452,363 A * 6/1984 Davis ..... B65D 50/046 215/216
4,534,391 A * 8/1985 Ventimiglia ..... A47G 23/0266 220/739
5,161,706 A * 11/1992 Weinstein ..... B65D 50/041 215/204
5,197,616 A * 3/1993 Buono ..... B65D 50/041 215/206
5,316,161 A * 5/1994 Gargione ..... B65D 50/041 215/220
5,381,917 A * 1/1995 Santagiuliana ..... B65D 50/041 220/219
5,551,582 A * 9/1996 Robinson ..... B65D 50/048 215/216
5,918,752 A * 7/1999 Meyer ..... B65D 50/041 215/204
7,614,516 B2 * 11/2009 Beggins ..... B65D 81/3879 215/386
8,302,792 B2 * 11/2012 Logel ..... B65D 41/3409 215/216
9,133,006 B2 * 9/2015 Kelley ..... B67C 7/00
2010/0237072 A1 * 9/2010 Ahn ..... B65D 50/041 220/254.8
2011/0142526 A1 * 6/2011 Raccah ..... B65D 50/041 401/129
2012/0138561 A1 * 6/2012 Brozell ..... B65D 50/041 215/220
2013/0220965 A1 * 8/2013 Jung ..... B65D 50/04 215/217
2013/0221007 A1 * 8/2013 Jung ..... B65D 41/3485 220/288
2015/0344193 A1 * 12/2015 Piscopo ..... B65D 50/041 53/492
2016/0167847 A1 * 6/2016 Jung ..... B65D 50/041 215/216
2016/0176590 A1 * 6/2016 Prater ..... B65D 50/041 206/525

* cited by examiner

[Fig. 1]
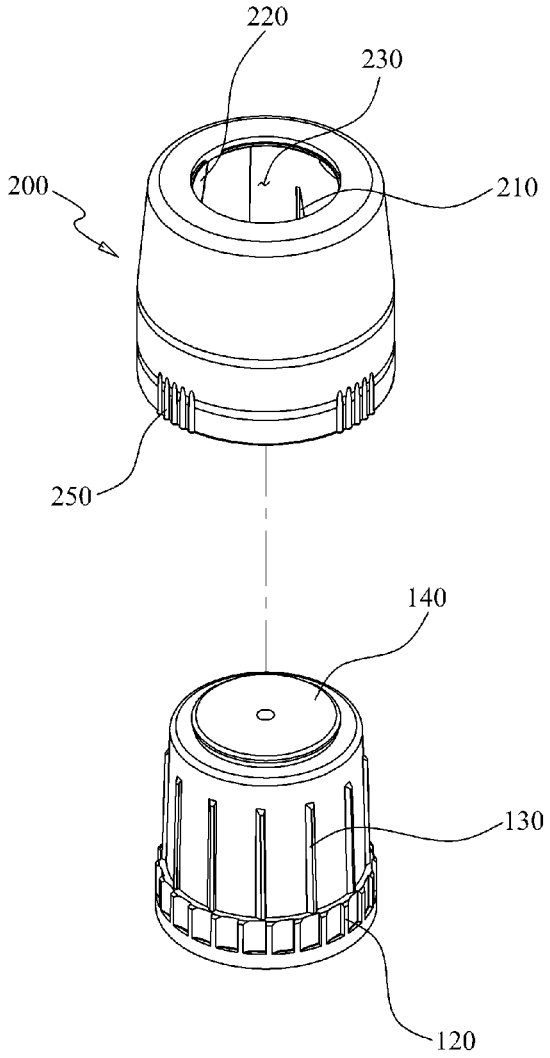

[Fig. 2]
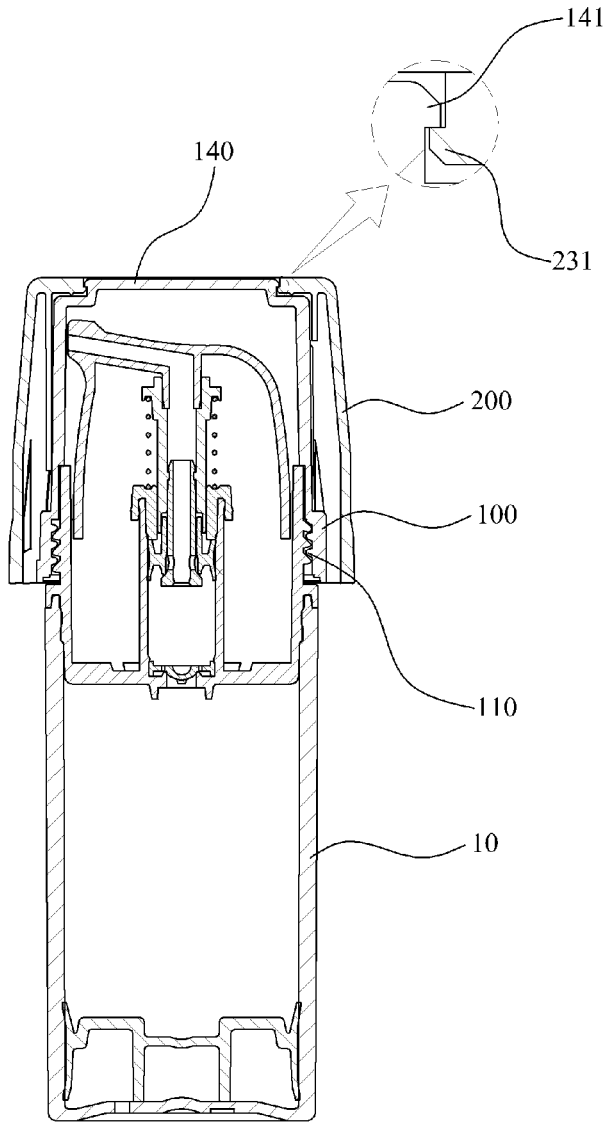

[Fig. 3]
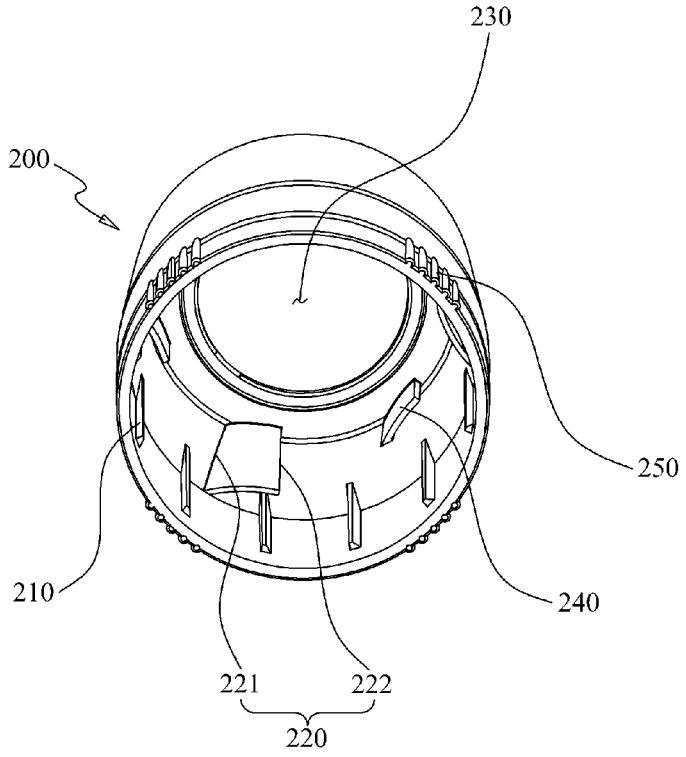

[Fig. 4]
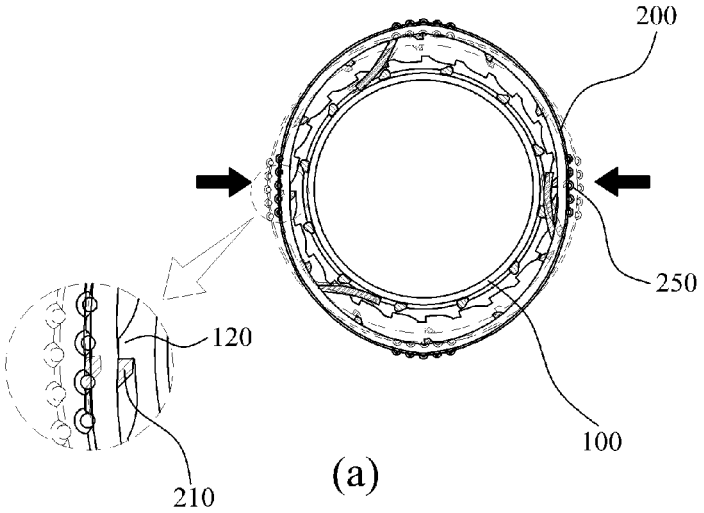
(a)
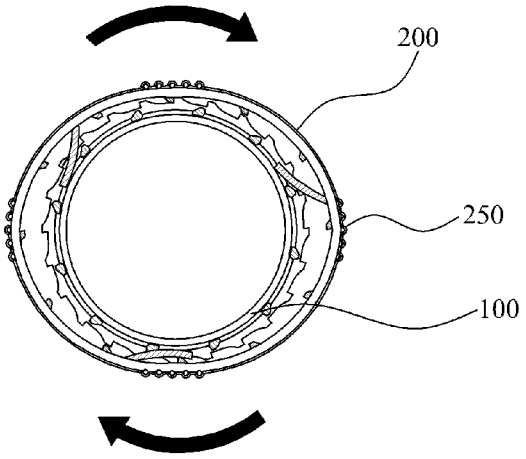
(b)

[Fig. 5]
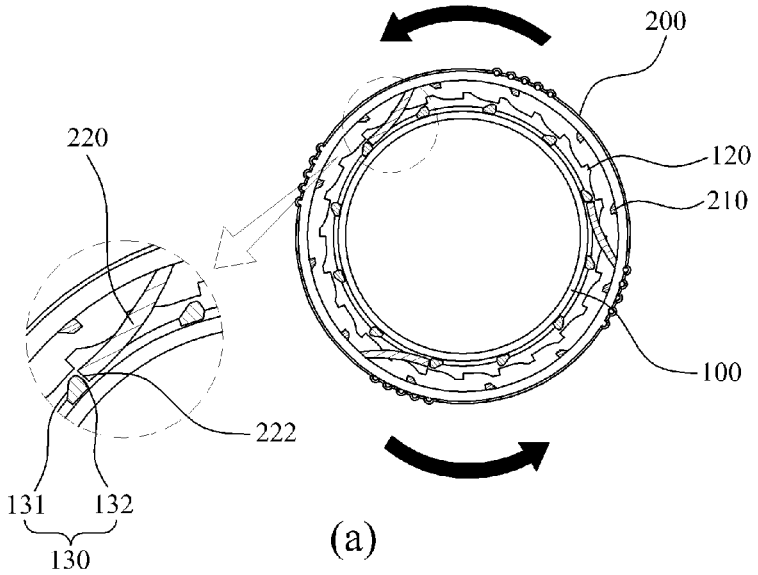
(a)
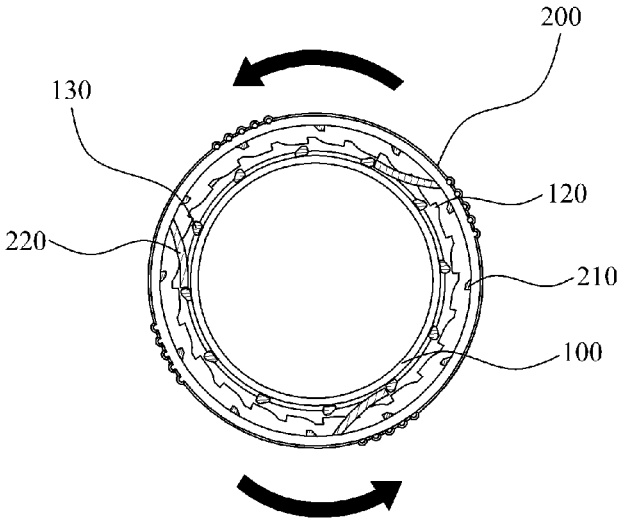
(b)

[Fig. 6]
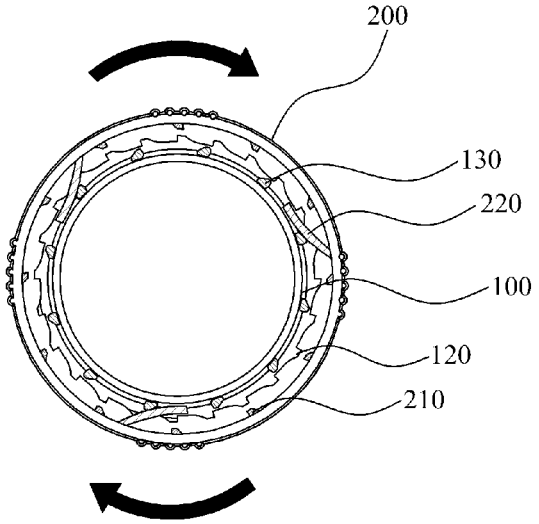
(a)
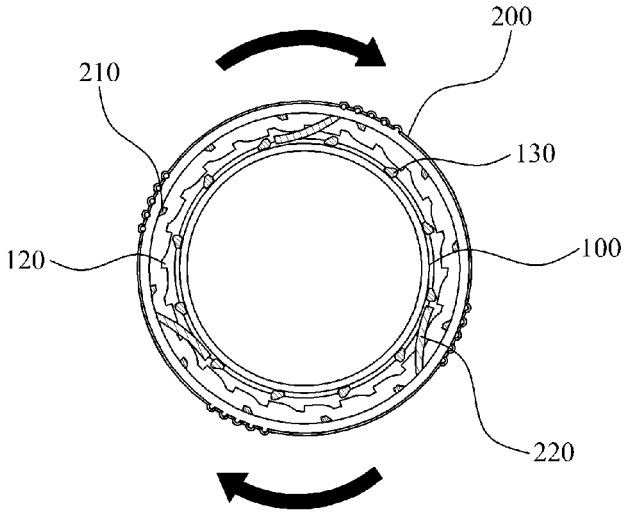
(b)

SIDE PRESS-TYPE SAFETY CAP

CROSS-REFERENCE TO RELATED APPLICATIONS

This U.S. utility patent application is a national stage application under 35 U.S.C. § 371 of international application PCT/KR2014/000734, filed Jan. 27, 2014, and claims the benefit of priority under 35 U.S.C. § 119 of Korean Patent Application No. 10-2014-0007657, filed Jan. 22, 2014, the entire contents of which are hereby incorporated herein by reference for all purposes.

TECHNOLOGICAL FIELD

The invention disclosed herein relates to a side press safety cap, and more particularly, to a side press safety cap, wherein when an outer cap is rotated into an opening direction with sides of an outer cap pressurized, a first rotation protrusion of an outer cap is interlocked with open guide protrusions of an inner cap and rotates the inner cap, and thereby makes an inner cap opened. On the other hand, when the outer cap is rotated into a closing direction, a second rotation protrusion is interlocked with close guide protrusions, rotating the inner cap and thereby the inner cap is closed. As a result, the side press safety cap is possible to be opened and closed stably.

BACKGROUND

Generally, a cap is combined to an upper portion of a container body, and prevents contents stored in the container body from being spilled and the contents from being contaminated as well.

These caps are configured to be able to be opened and closed easily by anyone by rotating to one or the other direction by means of screw coupling with a screw thread seated in the container body; therefore, the caps may be opened by children or the elderly who are less sensible, sometimes resulting in contents being spilled out. Particularly, it is reported that when contents that are stored in the container body are harmful to human bodies, children who are not aware of this often get involved in accidents by ingesting the contents.

In order to solve these problems above, there have been developed safety caps which have configurations wherein caps can be opened only when an upper portion of a cap is pressurized downwards or only when both sides of an upper portion of a cap are pressurized, thereby impossible to be opened easily by children.

Hereinafter, referring to Registered Korean Utility Models No. 0318864, "Bottle Assembly Preventing Children from Opening" (following as Registered Korean Utility Models), conventional safety caps will be described. Referring to the registered utility model above, conventional safety caps are a container assembly, comprising a hollow container body 10 where only a part of an upper portion is opened, and a lid 20 that covers and blocks an opening of the container, wherein the said container body 10 comprises a neck 14 which is extended with a relatively smaller diameter than other parts of the container, a discharging hole 11 that is formed with an upper end of the neck 14 opened, a male fastening screw 12 formed protusively to the circumference of the neck 14, a flange 13 which is formed, with prescribed width extended to an outward of the radial direction along a circumference of the neck 14 at a lower portion of the male fastening screw 12, and an engaging protrusion 15 that is formed protrudently at the upper surface of the flange 13; wherein the lid 20 comprises an upper engaging protrusion 25 formed on the inner wall surface corresponding to the engaging protrusion 15, an inner lid 23 formed with an inner diameter corresponding to the outer diameter of the discharging hole 11 inside of the lid 20, and a male fastening screw 22 formed protusively on inner wall surface of the inner lid 23 to be able to correspond to the male fastening screw 12.

However, because the conventional safety cap as the above has to form a flange 13 on the container body and a jamming protrusion 15 on a upper surface of the a flange 13 in order to form a jamming protrusion 15 that meets a upper side interference rising 25, a problem arise where the structure of the container body 10 becomes complicated and thereby it is impossible for general container installed with a screw thread to perform the function of a safety cap by combining with the lid 20.

To solve the problem above, the applicant discloses "a side press safety cap" with a simple structure, which was applied on Oct. 29, 2010 and registered as Registered Korean Patent No. 10-1221795 (following as the registered patent).

The registered patent is a safety cap which covers an upper portion of the container body and is coupled on upper portion with screw coupling, comprising:

an inner cap wherein a screw thread is formed on an inner circumference surface as encircling an upper portion of the container body and screw-coupled; an outer cap wherein a rotation protrusion is encircling the inner cap and is combined, is combined protusively with a multitude of combining protrusions on both of inner circumferential surfaces of the inner cap and is interlocked with the combining protrusion and rotates the inner cap; an inclined surface comprising a protruding piece which is protruded is protruded from an outer circumferential surface to the front direction, wherein the bent portion is curved gradually more gently as the distance becomes farther from the outer circumferential and a bent portion is bent from an end to one direction.

However, since the above registered patent has a problem wherein opening/closing of the cap is performed by a protruding interlocked structure, stability of operation not only falls down, but also when continuously used, an end of the bent portion may be broken or deformed, leading to failure of smooth opening/closing operation.

Furthermore, due to a separation space between the inner cap and the out cap, when the outer cap rotates, shaking condition of the outer cap against the inner cap occurs and stability of operation cannot be secured, thereby leading to customers' suspicion of the quality and eventually the drop in their trust in the goods.

SUMMARY OF THE DISCLOSURE

The present invention is devised to solve the said problems above, and the goal of the invention is to provide a side press safety cap, wherein, when an outer cap is rotated into an opening direction with sides of the outer cap pressurized, a first rotation protrusion of the outer cap is interlocked with open guide protrusions of an inner cap and rotates the inner cap, and thereby the inner cap is opened. On the other hand, when the outer cap is rotated into a closing direction, a second rotation protrusion is interlocked with close guide protrusions, rotating the inner cap and thereby the inner cap is closed. As a result of the configuration above, the side press safety cap is possible to be opened and closed stably Furthermore, it is to provide a side press safety cap wherein an elastic piece formed protusively from an inner circumferential surface of an outer cap is rotated as being contacted to an outer circumferential surface when the outer cap rotates, so that it is possible to prevent shaking of the outer cap when rotating.

To solve the problems above, according to the present invention, the side press safety cap comprises an inner cap wherein a screw thread is formed on an inner circumferential surface for the inner cap to be coupled to an upper portion of the container body with screws, and an outer cap which encircles the inner cap and is combined to the inner cap, furthermore, wherein on an outer circumferential surface of the inner cap one or more open guide protrusions and close guide protrusions are formed so as to be rotated with the outer cap when rotating the outer cap into an opening direction or closing direction, and on the inner circumferential surface of the outer cap are formed a first rotation protrusion that is interlocked with the open guide protrusions and rotates the inner cap when rotating the outer cap into an opening direction with sides of the outer cap being pressurized, and a second rotation protrusion that is interlocked with the close guide protrusions and rotates the inner cap when rotating the outer cap into an closing direction.

Furthermore, it is featured that the second rotation protrusion is formed and extended with a gentle curve from one point of an inner circumferential surface of the outer cap and goes over close guide protrusions when the outer cap is rotated to opening direction and is interlocked with the close guide protrusions when the outer cap is rotated to closing direction.

Furthermore, it is featured that the second rotation protrusion has a multitude of the second rotation guide formed encircling an inner circumferential surface with a regular distance apart.

Furthermore, it is featured that at the inner circumferential surface a a plurality of elastic pieces are provided. The elastic pieces are evenly spaced and extend from a point of an inner circumferential surface of the outer cap, forming a gently curved surface, wherein the elastic pieces are configured to be contacted to an outer circumferential surface of the inner cap and to prevent the outer cap from being shaken when the outer cap is rotated.

Furthermore, it is featured that a pressure display is formed on an outer circumferential surface of the outer cap to display a side pressure part of the outer cap.

According to the present invention as described on the above, the present invention, wherein when an outer cap is rotated into an opening direction with sides of the outer cap pressurized, a first rotation protrusion of the outer cap is interlocked with open guide protrusions of an inner cap and rotates the inner cap, and thereby an inner cap is opened; on the other hand, when the outer cap is rotated into a closing direction, a second rotation protrusion is interlocked with close guide protrusions, rotating the inner cap and thereby the inner cap is closed. Therefore, the side press safety cap is possible to be opened and closed stably.

Furthermore, the present invention, wherein elastic pieces formed protusively from an inner circumferential surface of the outer cap is configured to be rotated in a state of being contacted to the outer circumferential surface of the inner cap, and thereby prevents shaking of the outer cap when the outer cap is rotated.

BRIEF DESCRIPTION OF THE DRAWINGS

FIG. 1 is an exploded perspective view illustrating a configuration of a side pressure safety cap according to an exemplary embodiment of the present invention.

FIG. 2 is an assembled cross-sectional view illustrating a combined state of a side pressure safety cap to a container body according to an exemplary embodiment of the present invention.

FIG. 3 is perspective views illustrating an interior configuration of an outer cap of a side pressure safety cap according to an exemplary embodiment of the present invention.

FIGS. 4 and 5 are constitutional diagrams illustrating an open and close state of the combination of an inner cap and an outer cap according to an exemplary embodiment of the present invention.

DETAILED DESCRIPTION

Hereinafter, exemplary embodiments of the present invention will be described in details with reference to the accompanying drawings. The same reference numerals provided in the drawings indicate the same members.

FIG. 1 is an exploded perspective view illustrating a configuration of a side pressure safety cap according to an exemplary embodiment of the present invention. FIG. 2 is an assembled cross-sectional view illustrating a combined state of a side pressure safety cap to a container body according to an exemplary embodiment of the present invention. FIG. 3 is a perspective view illustrating a configuration of an outer cap of a side pressure safety cap according to an exemplary embodiment of the present invention.

Referring to FIGS. 1 to 3, a side pressure safety cap according to an exemplary embodiment of the present invention includes an inner cap 100, and an outer cap 200.

The inner cap 100 is combined with a screw coupling on a screw thread 110 installed on an upper portion of a container body 10 where contents are held, and opens/closes an opened upper portion of the container body 10, wherein a screw thread 11 are formed on the inner circumferential surface so as to be screw-coupled with the screw thread 11.

According to the present invention, on the outer circumferential of the inner cap 100 are formed open guide protrusions 120 and close guide protrusions 130 respectively so that the inner cap 100 can be rotated together according to rotation of an outer cap 200 into opening direction or closing direction of the outer cap 200 that will be explained later.

The open guide protrusions 120 encircles a lower portion of the outer circumferential surface of the inner cap 100, formed in a multitude positioned with a fixed distance apart, wherein when the outer cap 200 is rotated into opening direction in the state of a pressure display part 250 of the outer cap 200 being pressurized, it is possible that the open guide protrusions 120 can be rotated together with the inner cap 100 as interlocking with a first rotation protrusion 210 of the outer cap 200.

The open guide protrusions 120 is positioned with a fixed distance apart from the first rotation protrusion 210 of the outer cap 200 and thereby can be interlocked with the first rotation protrusion 210 only when pressurizing the pressure display part 250 of the outer cap 200; therefore, when the outer cap 200 is rotated into opening direction in a state of the pressure display part 250 of the outer cap 200 not being pressurized, the inner cap 100 will not be rotated and the outer cap 200 will run idle.

The close guide protrusions 130, encircling an outer circumferential surface of the inner cap 100 at an upper portion of the open guide protrusions 120, is positioned in a multitude with a fixed distance apart, wherein in the present invention, one of side surfaces of the close guide protrusions 130 includes a gently inclined plane 131 and the other includes a vertical plane 132 with an angle of nearly 90 degrees.

The close guide protrusions 130, when rotating the outer cap 200 into opening direction in a state of the pressure display part 250 of the outer cap 200 not being pressurized, makes it possible for a second rotation protrusion 220 of the outer cap 200 to go over the inclined plane 131, and on the other hand, when rotating the outer cap 200 into closing direction, the vertical plane 132 is interlocked with the second rotation protrusion 220 of the outer cap 200 and the inner cap 100 can be rotated together according to rotation of the outer cap 200.

Meanwhile, at an upper portion of the inner cap 100 is combined protusively a combining part 140 that is combined to a combining hole 230 of the outer cap 200 for preventing the inner cap 100 and the outer cap 200 from being separated, wherein on the combining part 140 is combined a protrusion 141 which is secured on a securing protrusion 231 of the outer cap 200 so as to be separated with the outer cap 200 when the outer cap 200 is separated from the container body 10.

The outer cap 200 encircles the inner cap 100 and is combined to be able to be rotated, thereby rotating the inner cap 100 as being interlocked with the open rotation protrusion 120 or the close rotation protrusion 130 according to the rotation either to opening direction or to closing direction and, wherein, in the present invention, on an inner circumferential surface of the outer cap 200 are installed the open guide protrusions 120, the close guide protrusions 130, and a first rotation protrusion 210 and a second rotation protrusion 220 that are interlocked respectively.

The first rotation protrusion 210, when the outer cap 200 is rotated to opening direction, is interlocked with the open rotation protrusion 120 of the inner cap 100, thereby making the inner cap 100 rotate, and is positioned in a multitude with a fixed distance apart along an inner circumferential surface of the outer cap 200.

The first rotation protrusion 210 is positioned with a narrow range detached from the open rotation protrusion 120 of the inner cap 100 in a state of a pressure display part 240 of the outer cap 200 being pressured, and is configured to be interlocked with open guide protrusions 120 of the inner cap 100 only when pressurizing the pressure display part 250 of the outer cap 200; therefore, when rotating the outer cap 200 to opening direction in a state of the pressure display part 250 of the outer cap 200 not being pressurized, the outer cap 200 is made to run idle while the inner cap 100 does not rotate, whereas the inner cap 100 can be rotated with the outer cap 200 when rotating the outer cap 200 in opening direction in a state of the pressure display part 250 of the outer cap 200 being pressurized.

The second rotation protrusion 220 is interlocked with close guide protrusion close guide protrusions 130 of the inner cap 100 and makes the rotation of the inner cap 100 possible when rotating the outer cap 200 to closing direction, and positioned in a multitude with a fixed distance apart along an inner circumferential surface of the outer cap 200.

In the present invention, the second rotation protrusion 220 extends from a point of an inner circumferential surface of the outer cap 200 forming a gently inclined plane. In a state of a pressure display part 250 of the outer cap 200 not being pressurized, the second rotation protrusion 220 is configured to go over the close guide protrusions 130 when the outer cap 200 is rotated to opening direction, whereas the second rotation protrusion 220 is configured to be interlocked with the close guide protrusions 130 rotating the inner cap 100 together when the outer cap 200 is rotated to closing direction. When rotating the outer cap 200 to closing direction, an end part 222 of the outer cap 200 meets a vertical plane 132 of the close guide protrusions 130 and delivers a rotating force of the outer cap 200 to the inner cap 100.

The second rotation protrusion 220 rotates the inner cap 100 together by making the outer cap 200 rotate to closing direction, thereby making it possible to screw-combine the inner cap 100 firmly to the container body 10 in the same way as a cap with a screw combination.

Meanwhile, on an upper end of the outer cap 200, a combining hole 230 is formed so that a combining part 140 of the inner cap 100 can be penetrated and combined, and a securing protrusion 231, wherein a protrusion 141 is secured encircling a combining hole 230, is formed so that the inner cap 100 can be detached along with the outer cap 200 when the outer cap 200 is detached from the container body 10.

Meanwhile, on an inner circumferential surface of the outer cap 200 are formed protusively a multitude of elastic pieces 240 with a fixed distance apart, extending from a point of an inner circumferential surface of the outer cap 200 as forming a gently curved surface so as to be contacted to an outer circumferential surface of the inner cap 100, wherein the elastic pieces 240 are contacted to an outer circumferential surface of the inner cap 100 and prevent the outer cap 200 from being shaken, which is caused by a space formed between the inner cap 100 and the outer cap 200 when the outer cap 200 rotates.

Meanwhile, on an outer circumferential surface of the outer cap 200 is installed a pressure display part 250 that is positioned corresponding to display a side pressure part of the outer cap 200, wherein the pressure display part 250 is configured to provide a function of preventing a user's hand from slipping when the outer cap 200 rotates in a state of a user's pressurizing the pressure display part 250.

Hereinafter, referring to FIG. 4 and FIG. 5, an opening and closing process of a side press safety cap according to an exemplary embodiment of the present invention is explained.

FIG. 4 and Fig. are constitutional diagrams illustrating an open and close state of the combination of an inner cap and an outer cap 200 according to an exemplary embodiment of the present invention.

Firstly, referring FIG. 4, when a safety cap is opened according to an exemplary embodiment of the present invention, both sides of the outer cap 200 go in slightly to inward direction and thereby a first rotation protrusion 210 of the outer cap 200 interlocks with open guide protrusions 120 of the inner cap 100. At this time, if the outer cap 200 is rotated to opening direction, rotating force of the outer cap 200 is delivered to the open guide protrusions 120 interlocked with the first rotation protrusion 210 of the outer cap 200 and then rotates with the inner cap 100 together.

As the above, when the inner cap 100 rotates into opening direction, a screw combination of the inner cap 100 is released from the container body 10, and thereby a safety cap gets to be opened.

Next, referring to FIG. 5, when a side press safety cap according to an exemplary embodiment of the present invention is closed, a user rotates the outer cap 200 to closing direction at a state of the outer cap 200 being pressurized. When the outer cap 200 rotates, then a second rotation protrusion 220 installed on an inner circumferential surface of the outer cap 200 rotates, and at this time, an end portion 222 of the second rotation protrusion 220 meets to a vertical plane 132 of close guide protrusions 130, thereby rotating the inner cap 100 together.

As the above, when the inner cap 100 rotates to closing direction, the inner cap 100 screw-combines to the container body 10, thereby being able to close the safety cap in the same way as a general screw-combining type of safety caps closes a container body.

On the other hand, in the present invention, when the safety cap opens, if the outer cap 200 is rotated to opening direction at a state of a pressure display part 250 of the outer cap 200 not being pressurized, then open guide protrusions 120 and a first rotation protrusion 210 are positioned, detached from each other as in FIG. 6, thereby the open guide protrusions 120 and the first rotation protrusion 210 being dislocated, and then the outer cap 200 running idle. As a result, the rotating force of the outer cap 200 is not delivered to the inner cap 100 and does not make the inner cap 100 rotated, therefore it is impossible to open a safety cap.

The present invention, when opening or closing the safety cap, is able to open and close the safety cap, utilizing different opening and closing structures respectively; therefore, it is possible to prevent an open and close structure from being broken or deformed in the process of opening and closing, and thereby, also possible to open and close the safety cap safely.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Therefore, those skilled in the art will appreciate that various modifications and other equivalent embodiments are possible from the above embodiments. Therefore, the scope of the present invention should be defined by the technical spirit of the accompanying claims.

What is claimed is:

1. A side press safety cap, comprising:

an inner cap forming a screw thread at an inner circumferential surface so as to be threadably coupled to an upper portion of a container body where contents are stored, and an outer cap encircling and rotatably coupled to the inner cap, wherein one or more open guide protrusions and close guide protrusions are equipped at an outer circumferential surface of the inner cap, so as to be rotated together with the outer cap when rotating the outer cap in an opening direction or in a closing direction, wherein an inner circumferential surface of the outer cap includes a first rotation protrusion which interlocks with the open guide protrusion and rotates the inner cap when the outer cap is rotated in the opening direction responsive to sides of the outer cap being pressurized, and a second rotation protrusion which interlocks with the close guide protrusions and rotates the inner cap when the outer cap is rotated in the closing direction, and wherein the inner circumferential surface of the outer cap further includes a plurality of elastic pieces that are evenly spaced from one another and extend from the inner circumferential surface so as to form a gradually curved surface, wherein the plurality of elastic pieces is configured to contact the outer circumferential surface of the inner cap and to prevent the outer cap from being shaken when the outer cap rotates.

2. The side press safety cap of claim 1, wherein the second rotation protrusion forms a gradual curve that extends from the inner circumferential surface of the outer cap and extends over the close guide protrusions when the outer cap is rotated in the opening direction, and wherein the second rotation protrusion interlocks with the close guide protrusions when the outer cap is rotated in the closing direction.

3. The side press safety cap of claim 2, wherein a plurality of second rotation protrusions are evenly spaced along the inner circumferential surface of the outer cap.

4. The side press safety cap of claim 1, wherein pressure display parts are provided on an outer circumferential surface of the outer cap so as to display portions of the outer cap on which a user is to apply pressure.

* * * * *